United States Patent [19]

Ogata

[11] Patent Number: 4,837,196

[45] Date of Patent: Jun. 6, 1989

[54] HEAT-SENSITIVE RECORDING PAPER

[75] Inventor: Yasuhiro Ogata, Shizuoka, Japan

[73] Assignee: Fuji Photo Film Co., Ltd., Kanagawa, Japan

[21] Appl. No.: 160,972

[22] Filed: Feb. 26, 1988

[30] Foreign Application Priority Data

Feb. 27, 1987 [JP] Japan ..... 62-44795

[51] Int. Cl.[4] ..... B41M 5/18

[52] U.S. Cl. ..... 503/200; 427/152; 428/211; 428/342; 428/537.5; 428/913; 503/226

[58] Field of Search ..... 427/150–152; 428/195, 500, 507, 913, 914, 211, 342, 537.5; 503/200, 226

[56] References Cited

U.S. PATENT DOCUMENTS

| | | | |
|---|---|---|---|
| 2,397 | 1/1985 | Ricoh | 503/200 |
| 116,692 | 7/1982 | Ricoh | 503/200 |

*Primary Examiner*—Bruce H. Hess

*Attorney, Agent, or Firm*—Sughrue, Mion, Zinn, Macpeak & Seas

[57] ABSTRACT

A novel heat-sensitive recording paper is provided, which comprises a paper support having thereon a heat-sensitive color forming layer comprising at least one electron-donating colorless dye precursor and at least one electron-accepting compound, wherein the paper support comprises a base paper having thereon a layer containing styrene-acryl copolymer.

11 Claims, No Drawings

HEAT-SENSITIVE RECORDING PAPER

FIELD OF THE INVENTION

The present invention relates to a heat-sensitive recording paper. More particularly, the present invention relates to a heat-sensitive recording paper which uses a color reaction between a colorless or light-colored electron-donating dye precursor and an electron-accepting compound.

BACKGROUND OF THE INVENTION

A heat-sensitive recording material using a color reaction of a colorless or light-colored electron-donating dye precursor with an electron-accepting compound, i.e., a two-component system heat-sensitive recording material, is disclosed, for example, in Japanese Patent Publication Nos. 14039/70 and 4160/68.

A two-component system color heat-sensitive recording material comprises a mixture of a particulate dispersion of a colorless or light-colored electron-donating dye precursor (hereinafter referred to as "color former") with a binder and a mixture of a particulate dispersion of an electron-accepting compound (hereinafer referred to as "color developer") with a binder, both heat-reactive components being coated on a support with a binder interposed therebetween. In such an arrangement, when one or both of the two heat-reactive components are melted on heating, the color forming compounds are brought into contact with each other to undergo a color reaction by which recording is effected. Such a two-component system color heat-sensitive recording material is advantageous in that it undergoes a primary color reaction which requires no development, that the paper quality can be nearly that of commonly used paper, that it can be easily handled, that it provides a high color density, and that it provides various color hue heat-sensitive recording materials. Thus, the two-component system color heat-sensitive recording material finds the widest application as a heat-sensitive recording material.

In particular, the heat-sensitive recording material has recently found increasing application in facsimile telegraph, recorder, and printer devices. In order to increase the recording speed of, for example, a facsimile device, the rate of travel of the recording head is increased and the duration of the pulse of thermal energy is shortened. This has required that heat-sensitive recording material be developed to be sensitive enough to a short pulse width, i.e., small heat energy to develop color with a sufficient density. Various attempts have been made as disclosed in Japanese Patent Application (OPI) Nos. 18739/83, 67083/84 and 54884/85 (the term "OPI" as used herein means an "published unexamined Japanese patent application").

A problem in such high speed heat-sensitive recording is that sufficient heat conduction cannot be made between the thermal head and the heat-sensitive recording paper with which the thermal head is in contact, making it impossible to provide sufficient recording density. This has been a major factor that prevents the heat-sensitive recording paper from being used in high speed recording. A thermal head is an assembly of dot-shaped electrical resistance heating elements which respond to a recording signal to produce heat. When these electrical resistance heating elements are brought into contact with the heat-sensitive color forming layer, the heat-sensitive color forming layer is molten to develop color. In order to provide sharp and high density recording, an excellent dot reproducibility is required. In other words, the thermal head and the heat-sensitive color forming layer need to be in close contact with each other to provide a more efficient heat conduction therebetween so that dots having a shape corresponding to that of the dot-shaped heating elements can be formed on the heat-sensitive color forming layer in fully developed colors in full response to high speed recording signals. At present, however, only a small percentage of heat produced by the thermal head is transmitted to the heat-sensitive color forming layer. Thus, the efficiency of heat conductance between the two components is still extremely low.

Heretofore, several approaches have been proposed to improve the surface smoothness of the heat-sensitive color forming layer so that the thermal head and the heat-sensitive color forming layer come into as close contact as possible with each other.

For example, Japanese Patent Publication No. 20142/77 describes a method which comprises treatment of the surface of a heat-sensitive color forming layer to a Bekk smoothness of 200 to 1,000 seconds. Japanese Patent Application (OPI) No. 115255/79 describes that when a Bekk smoothness is from 200 to 1,000 seconds, the heat-sensitive color forming layer can respond only to heat impulses of from about 5 to 6 milliseconds, and that for high-speed recording using heat impulses of not more than 1 millisecond it is necessary for the surface of the heat-sensitive color forming layer to be made smooth to such an extent that the Bekk smoothness is not less than 1,100 seconds. However, when the Bekk smoothness is increased to not less than 1,100 seconds, color fog is produced upon application of pressure. The formation of color fog is prevented by using a base paper which has been previously made smooth to an extent that the Bekk smoothness is 500 seconds or more. Japanese Patent Publication No. 43318/85 describes a method which comprises the use of a extracted hot water-containing base paper having a pH value of 6 to 9 to prevent fog. Japanese Patent Application (OPI) No. 56086/78 describes that the surface roughness, Ra, of the heat-sensitive color-forming layer is made to be less than 1.2 $\mu$m, and the glossiness less than 25%.

In all the above-described prior art techniques, the smoothness of the heat-sensitive color-forming layer is increased only by calender processings such as super calendering, machine calendering, and gloss calendering. This calendering is applied to the base paper alone, or the base paper and the heat-sensitive paper, or the heat-sensitive paper alone. In the heat-sensitive recording paper, however, as the smoothness is increased by the calendering in order to increase the recording density, adherence and accumulation are increased. In practical use, therefore, the smoothness is suppressed to a suitable level so that the recording density and the occurrence of adherence and accumulation are properly balanced. In the prior art techniques, regardless of the smoothness level, the resulting heat-sensitive recording paper is unsuitable for practical use for high-speed recording in respect of recording density and recording stability.

The term "adherence" (sticking) as used herein refers to a phenomenon wherein the thermal head adheres to the heat-sensitive color-forming layer, thereby producing stripping noise and lowering the dot reproducibility.

The term "accumulation" (piling) refers to a phenomenon wherein heat-melted products of the heat-sensitive color-forming layer accumulate on the thermal head, thereby lowering the recording density and dot reproducibility. Both of these phenomena inhibit stable recording.

Another disadvantage as encountered in applying the calender processing to the heat-sensitive recording paper is that color fog is formed by pressure, resulting in an increase in the density of the background of the recording paper. Similarly, in the calendering processing of the base paper, so-called cockle, wrinkles, etc. due to unevenness in basis weight develop. Thus it is limited in its practical use. As described above, the attempt to increase the smoothness of the heat-sensitive color-forming layer by calendering processing so as to increase the recording density has met with only limited success, and the resulting heat-sensitive recording paper is not sufficiently satisfactory for use in high-speed recording.

Japanese Patent Application (OPI) Nos. 2397/85 and 176091/84 describe a method which comprises incorporation of an anionic copolymer. However, this method leaves to be desired in that a sufficient recording density cannot be obtained.

Japanese Patent Application (OPI) No. 184875/85 describes a method which comprises incorporation of a maleic anhydride copolymer/polyalkylene polyamine reaction product as a cationic softening agent. However, this method is disadvantageous in that a base paper thus prepared has a poor surface strength, causing dusting or fluffing upon calendering.

Such a manufacturing trouble occurs particularly when the base paper is neutralized and comprises calcium carbonate as a filler material.

SUMMARY OF THE INVENTION

It is therefore an object of the present invention to provide, on a stable manufacturing basis, a heat-sensitive recording paper which exhibits a high recording density and excellent dot reproducibility and is less subject to fog and stain on the thermal head.

It is another object of the present invention to provide a support which does not cause dusting, fluffing or the like upon calendering or supercalendering of the base paper.

These and other objects of the present invention will become more apparent from the following detailed description and example.

These objects of the present invention are accomplished with a heat-sensitive recording paper comprising a paper support having thereon a heat-sensitive color forming layer comprising at least one electron-donating colorless dye precursor and at least one electron-accepting compound, wherein the paper support comprises a base paper having thereon a layer containing a cationic styrene-acryl copolymer.

DETAILED DESCRIPTION OF THE INVENTION

The cationic styrene-acryl copolymer to be used in the present invention comprises as a main component a copolymer of:

(a) a styrenic monomer selected from the group consisting of styrene monomers and monomers containing a styrene skeleton such as alkyl styrene, dialkyl styrene, trialkyl styrene, alkenyl styrene, alkylalkenyl styrene, aryl styrene, and alkylaryl styrene; with (b) an acrylic monomer selected from the group consisting of acrylic acid, methacrylic acid, acrylic ester, methacrylic ester, and amino compounds thereof such as dimethylaminoethyl methacrylate, dimethylaminoethyl acrylate, dimethylaminoethyl methacrylamide, 2-dimethyl- amino-1-methylethyl acrylate, 2-dimethylamino-1-methylethyl methacrylate, and dimethylaminoethyl acrylamide.

Preferably, the cationic styrene-acryl copolymer may be used in combination with epichlorohydrin.

The molar ratio of styrene to acryl is preferably in the range of 99/1 to 5/95, more preferably 99/1 to 10/90, and particularly preferably 99/1 to 30/70.

The cationic styrene-acryl copolymer of the present invention is preferably used in the form of aqueous solution.

The aqueous solution of the present cationic styrene-acryl copolymer may be used singly or in combination with starch, PVA(polyvinyl alcohol), latex, pigment, dye, or the like.

In order to render the copolymer of styrene with acryl cationic, a vinyl monomer containing a nitrogen atom, preferably quatarnarized nitrogen atom is preferably used as a copolymerizable component.

Specific examples of such a vinyl monomer containing a nitrogen atom include vinyl pyridine, vinyl quinoline, dimethyl aminoethyl acrylate, dimethylaminoethyl methacrylate, 2-dimethyl-1-methylethyl acrylate, 2-dimethylamino-1-methylethyl methacrylate, and dimethylaminoethyl acrylamide.

The nitrogen group contained in such a nitrogen-containing monomer is preferably basic. Thus, such a monomer is preferably treated with a water-soluble acid such as hydrochloric acid and acetic acid or a halogenated alkyl compound such as benzyl chloride and butyl bromide to become a quaternary ammonium salt.

These polymer salts or copolymer salts may further comprise a melamine resin, urea resin or the like as a third component incorporated therein. These polymer salts or copolymer salts may be further modified by an epoxy or the like to improve the reactivity of the sizing agent to be used therewith.

An aqueous solution of the cationic styrene-acryl copolymer may be advantageously coated on the support by a sizing bath, sizing press, gate roll coater or the like on machine. The aqueous solution may be coated on the support by an air knife coater, bar coater or the like off machine. The amount of the cationic styrene-acryl copolymer to be coated is preferably in the range of from 0.005 to 3.0 g/m$^2$, and particularly preferably in the range of from 0.01 to 2.0 g/m$^2$.

The base paper to be used in the present invention is produced mainly from wood pulp such as NBKP(Nadelholz Bleached Kraft Pulp), LBKP(Laubholz Bleached Kraft Pulp), NBSP(Nadelholz Bleached Sulfite Pulp) and LBSP(Laubholz Bleached Sulfite Pulp). In addition, it can be produced from mixtures of wood pulp and synthetic fibers such as vinylon or synthetic pulp such as polyethylene. As such wood pulp there may be used either soft wood pulp or hardwood pulp. Hardwood pulp, which gives short fibers and thus easily provides smoothness, may be preferably used in the present invention. The freeness of such pulp is preferably in the range of 150 to 600 cc of Canadian Standard Freeness(C.S.F.), and more preferably 200 to 450 cc. The pulp may further optionally comprise various internal additives. Specific examples of such internal additives include sizing agents such as rosin, paraffin wax, higher fatty acid salt, alkenylsuccinate, anhydrous fatty acid, and alkylketene dimer; paper strength increasing agents such as polyacrylamide, starch, PVA, and melamine-formaldehyde condensate; softening agents such as maleic anhydride copolymer/polyalkylene polyamine reaction products and quaternary ammonium salts of higher fatty acids; filler materials such as calcium carbonate, talc, clay, kaolin, titanium oxide, and urea resin fine particles; fixing agents such as cationized starch, aluminum sulfate, polyamide, polyamine, and epichlorohydrin; dyes; and fluorescent dyes.

The effects of the present invention can be most remarkably attained when the base paper is produced in accordance with a neutralizing process.

Therefore, as the internal sizing agent, there may be preferably used a reactive sizing agent such as alkylketene dimer and alkylsuccinic anhydride, particularly alkylketene dimer.

The amount of such an internal sizing agent is preferably in the range of 0.01 to 1.0% by weight, particularly 0.02 to 0.3% by weight based on the dry weight of pulp.

As such a filler material there may be preferably used calcium carbonate or talc, particularly calcium carbonate.

The amount of the filler material to be added is preferably in the range of 0.5 to 30% by weight, particularly 3 to 20% by weight based on the dry weight of pulp.

The base paper to be used in the present invention may be produced by mixing these starting materials and then processing the mixture through a Fourdrinier paper machine or cylinder paper machine. The preferred paper support for use in the present invention has a basis weight of 30 to 200 g/m$^2$. The paper support to be used in the present invention may be a paper material which has been finished by on-machine or off-machine calendering processing so that the density thereof reaches 0.80 to 0.98 g/cm$^3$.

The paper support further may have a subbing layer mainly made of a pigment provided thereon.

The heat-sensitive coating solution for the formation of the heat-sensitive color-forming layer to be used in the present invention will be described hereinafter.

In the preparation of the heat-sensitive coating solution, a color former and a color developer are separately dispersed in water-soluble high molecular compound solutions by means of a ball mill or the like. The preparation of the desired finely divided dispersion of the color former or color developer can be accomplished, for example, by combining the desired ingredients in the desired proportions and dispersing with balls of different diameters for a sufficient period of time. Alternatively, a model sand mill (trademark, Dynomill®, or the like may be effectively used.

The dispersion of color former and the dispersion of color developer thus prepared are mixed with each other. The admixture may then be mixed with an inorganic pigment, wax, higher fatty acid amide, and metallic soap, and if desired, ultraviolet absorber, antioxidant, latex binder, or the like to provide the desired coating solution. These additives may be added to the material during the dispersion process.

The coating solution thus prepared is normally coated on the support in such a manner that the amount of the color former coated is from 0.2 to 1.0 g/m$^2$, and the amount of the color developer coated is from 0.1 to 2.0 g/m$^2$.

The color former to be used in the present invention is not specifically limited, and may be any of those conventionally used in pressure-sensitive recording paper, heat-sensitive recording paper, or the like. Specific examples of such a color former include triarylmethane phthalide compounds such as 3,3-bis(p-dimethylaminophenyl) -6-dimethylaminophthalide (i.e., Crystal Violet Lactone), 3-(p-dimethylaminophenyl)-3-(1,2-dimethylindol-3-yl)phthalide, 3-(p-dimethylaminophenyl)-3-(2-phenylindol-3-yl)phthalide, 3,3-bis(p-ethylcarbazol-3- yl)-3-dimethylaminophthalide, and 3,3-bis-(2-phenylindol-3-yl)-5-dimethylaminophthalide; diphenylmethane compounds such as 4,4-bis-dimethylaminobenzhydrin benzylether, N-halophenylleucoauramine, and N-2,4,5-trichlorophenylleucoauramine; xanthene compounds such as Rhodamine B-anilinolactam, 3-diethylamino-7-dibenzylaminofluoran, 3-diethylamino-7-butylaminofluoran, 3-diethylamino-7-(2-chloroanilino)-fluoran, 3-diethylamino-6-methyl-7-anilinofluoran, 3-piperidino-6-methyl-7-anilinofluoran, 3-ethyltolylamino-6-methyl-7-anilinofluoran, 3-cyclohexyl-methylamino-6-methyl-7-anilinofluoran, 3-diehtylamino-6-chloro7-(β-ethoxyethyl)aminofluoran, 3-diethylamino-6-chloro-7(γ-chloropropyl)aminofluoran, 3-diethylamino-6-chloro-7-anilinofluoran, 3-N-cyclohexyl-N-methylamino-6-methyl-7-anilinofluoran, and 3-diethylamino-7-phenylfluoran; thiazine compounds such as benzoylleucomethylene blue, and p-nitrobenzoylleucomethylene blue; spiropyran compounds such as 3-methyl-spiro-dinaphthopyran, 3-ethylspirodinaphthopyran, 3-benzylspiro-dinaphthopyran, and 3-methylnaphtho-(3-methoxybenzo)-spiropyran, etc.

These compounds can be used singly or in combination with each other. These compounds may be selected based on intended application and desired properties.

Preferred color developers for the present invention are phenol derivatives or aromatic carboxylic acid derivatives, particularly bisphenols.

Specific examples of such phenol derivative include p-octylphenol, p-tert-butylphenol, p-phenylphenol, 2,2-bis(p-hydroxyl)propane, 1,1-bis(p-hydroxyphenyl)pentane, 1,1-bis(p-hydroxyphenyl)hexane, 2,2-bis(p-hydroxyphenyl)hexane, 1,1-bis(p-hydroxyphenyl)-2-ethylhexane, and 2,2-bis(4-hydroxy-3,5-dichlorophenyl)propane.

Specific examples of such aromatic carboxylic acid derivatives include p-hydroxybenzoic acid, propyl p-hydroxybenzoate, butyl p-hydroxybenzoate, benzyl p-hydroxybenzoate, 3,5-α-methylbenzylsalicylic acid, and polyvalent metallic salts thereof.

In order that the color developer melts at the desired temperature and undergoes a color-forming reaction, it is preferred that the color developer be added as a eutectic mixture in combination with a heat-fusible substance having a low melting point, or in the state that such a low melting substance is fused to the surface of color developer particles.

Waxes which can be used include paraffin wax, carnauba wax, microcrystalline wax, and polyethylene wax. In addition, higher fatty acid amides such as stearic acid amide, ethylenebisstearoamide, higher fatty acid esters, etc., can be used.

Metallic soaps which can be used include higer fatty acid polyvalent metal salts such as zinc stearate, aluminum stearate, calcium stearate, and zinc oleate.

Inorganic pigments which can be used include kaolin, calcined kaolin, talc, agalmatolite, diatomaceous earth, calcium carbonate, aluminum hydroxide, magnesium hydroxide, magnesium carbonate, titanium oxide, and barium carbonate.

For these inorganic pigments it is preferred that the amount of oil absorbed is at least 60 ml/100 g and the average particle diameter, 5 μm or less. In the case of oil-absorbing inorganic pigments, it is desirable that they be compounded in the recording layer in a dry amount of from 5 to 50% by weight, with the range of from 10 to 40% by weight being preferred.

They are dispersed in a binder and coated. In general, water-soluble binders are used for this purpose, including polyvinyl alcohol, hydroxyethyl cellulose, hydroxypropyl cellulose, an ethylene/maleic anhydride copolymer, a styrene/maleic anhydride copolymer, an isobutylene/maleic anhydride copolymer, polyacrylic acid, starch derivatives, casein, and gelatin.

Compounds for imparting water-resistance (i.e., gelling agents and cross-linking agents), and hydrophobic polymer emulsions such as a styrene/butadiene rubber latex and an acryl resin emulsion can be added for the purpose of imparting water resistance to the above binders.

The amount of the binder in the color forming layer (i.e., recording layer) is from 10 to 30% by weight, indicated as dry weight. In addition, if desired, other auxiliary additives such as defoaming agents, fluorescent dyes, and coloring dyes may be added to the coating solution.

In the formation of the color forming layer, the above coating solution can be coated by known coating techniques, such as blade coating, air knife coating, gravure coating, roll coating, spray coating, dip coating, bar coating, and extrusion coating.

The amount of the coating solution coated on the paper support for forming the color forming layer is not critical; it is usually from 3 to 15 g/m$^2$, indicated as dry weight, with the range of from 4 to 10 g/m$^2$ being preferred.

The present heat-sensitive recording paper made of a paper support containing a cationic styrene-acryl copolymer is advantageous in that the thermal recording layer provided thereon exhibits a wider area of contact with the thermal head upon recording, giving a high recording density and an excellent dot reproducibility, that it is less subject to fogging and gives less sticking, piling and stain to the thermal head, and that the paper support can be stably supplied without causing dusting, fluffing, or the like upon calendering or supercalendering of the base paper.

The present invention will be further illustrated in the following example, but the present invention should not be construed as being limited thereto. Unless otherwise indicated, all parts, percents, ratios and the like are by weight.

EXAMPLE 90 parts of LBKP and 10 parts of NBKp were beaten by means of a disc refiner to reach a Canadian Standard Freeness of 300 cc. Cationic starch and alkylketene dimer were added to the pulp mixture in amounts of 0.5 part by weight and 0.1 part by weight based on the absolute dry weight of the pulp mixture, respectively. Furthermore, 10 parts of calcium carbonate and 0.01 part of cationic polyacrylamide were added to the mixture. With this starting material thus prepared, a base paper was produced by means of a Fourdrinier paper machine. Surface sizing agents were coated on the paper samples by means of a size press on the paper machine as shown in Table 1 to obtain paper supports having a basis weight of 50 g/m$^2$. These samples were then supercalendered off machine to adjust the thickness thereof to 55 μm.

These samples were visually compared for dusting to the calender roll. The results are shown in Table 2.

Thus, four kinds of support samples of the present invention and four kinds of comparative support samples were prepared.

These support samples were then coated with a coating solution prepared as described later in a manner as described later to obtain heat-sensitive recording paper samples. These heat-sensitive recording paper samples were subjected to heat-sensitive recording and then measured for recording density in a manner as described later. The results are shown in Table 2.

Preparation of heat-sensitive coating solution 5 g of 2-anilino-3-methyl-6-cyclohexylamethylaminofluoran as a color former was subjected to dispersion with 25 g of 5% polyvinyl alcohol (PVA-105, manufactured by Kuraray Co., Ltd) in a 100 ml ball mill for a 24-hour period to prepare a color former dispersion.

10 g of bisphenol A as a color developer and 10 g of β-naphthylbenzyl ether as a sensitizer were mixed. The admixture was subjected to dispersion with 100 g of 5% polyvinyl alcohol in a 300-ml ball mill for a 24-hour period to prepare a mixed dispersion of color developer and sensitizer.

25 g of calcium carbonate as a pigment obtained by the milk of lime carbonic acid gas reaction process (see Table 1 for calcium hydroxide content) was subjected to dispersion with 30 g of a 0.5% solution of sodium hexametaphosphate in a homogenizer to prepare a pigment dispersion.

The oil absorption of calcium carbonate used was 50 to 55 ml/100 g.

These three dispersions thus prepared were mixed. Ten grams of a 30% dispersion of zinc stearate (Hidrin Z-7, manufactured by Chukyo Yushi Co., Ltd.) was added to the mixture to obtain the desired coating solution.

Coating process

The coating solution thus prepared was coated onto one side of the base paper by means of an air knife coater in an amount of 6 g/m$^2$ as calculated in terms of solid content. The coat was dried in a 50° C. hot air drier, and then machine-calendered.

Evaluation of heat-sensitive recording paper

These samples were subjected to solid print by means of a printing tester manufactured by Kyocera Corporation under conditions of 0.35 W/dot, pulse width of 1.2 ms, and printing density of 8 dot/mm×7.7 dot/mm (35 mj/mm$^2$). These samples were then measured for density by means of Macbeth reflection densitometer Model 918 (#106 filter used).

The greater the density value is, the higher and better the printing sensitivity is. For dot reproducibility, the printed portions were visually checked. The thermal head was visually checked for evaluation of stain after printing.

For evaluation of anti-fogging property, the coated paper samples were stored in an atmosphere of 40° C. and 90% RH for 24 hours. After this exposure, these samples were measured for reflection density. The lower the reflection density value is, the lower the degree of fogging is and higher the degree of whiteness is.

TABLE 1

| Run No. | Type of surface sizing agent | Coated amount |
|---|---|---|
| Example 1 (present invention) | Cationic styrene-acryl copolymer (1)* | 0.1 g/m$^2$ |
| Example 2 (present invention) | Cationic styrene-acryl copolymer (2)** | 0.1 g/m$^2$ |
| Example 3 (present invention) | 1:1 Mixture of cationic styrene-acryl copolymer (1) and alkyl ketene dimer | 0.2 g/m$^2$ |
| Example 4 (present invention) | 1:1 Mixture of cationic styrene-acryl copolymer (2) and starch | 0.2 g/m$^2$ |
| Comparative Example 1 | None | 0 g/m$^2$ |
| Example 2 | Starch | 0.1 g/m$^2$ |
| Example 3 | Alkylketene dimer | 0.1 g/m$^2$ |
| Example 4 | Epoxidized fatty acid amide*** | 0.1 g/m$^2$ |

*Copolymer of styrene, dimethylaminoethyl methacrylate, and epichlorohydrin
**Epichlorohydrin addition product of styrene-acrylic acid copolymer
***Epichlorohydrin of stearic acid/polyvalent amine reaction product

TABLE 2

| Run No. | Dusting during supercalender upon preparation of base paper | Printing density | Dot reproducibility | Reflection Density (Degree of Fogging) | Stain on head |
|---|---|---|---|---|---|
| Example 1 | Good | 1.18 | Excellent | 0.07 | Good |
| Example 2 | Good | 1.15 | Excellent | 0.08 | Good |
| Example 3 | Good | 1.18 | Excellent | 0.08 | Good |
| Example 4 | Good | 1.14 | Excellent | 0.09 | Good |
| Comparative Example 1 | Poor | 0.95 | Fair | 0.12 | Somewhat poor |
| Example 2 | Good | 0.85 | Poor | 0.14 | Poor |
| Example 3 | Poor | 0.10 | Good | 0.10 | Somewhat poor |
| Example 4 | Poor | 0.10 | Good | 0.10 | Somewhat poor |

Table 2 shows that the heat-sensitive recording paper samples of the present invention exhibit a high recording density, excellent dot reproducibility, less stain on the head, and less dusting at the supercalender during the preparation of the base paper.

While the invention has been described in detail and with reference to specific embodiments thereof, it will be apparent to one skilled in the art that various changes and modificaitons can be made therein without departing from the spirit and scope thereof.

What is claimed is:

1. A heat-sensitive recording paper comprising a paper support having thereon a heat-sensitive color forming layer comprising at least one electron-donating colorless dye precursor and at least one electron-accepting compound, wherein the paper support is made of a base paper impregnated with a cationic styrene-acryl copolymer.

2. A heat-sensitive recording paper as in claim 1, wherein the cationic styrene-acryl copolymer is incoporated into the base paper by size-press.

3. A heat-sensitive recording paper as in claim 1, wherein the cationic styrene-acryl copolymer comprises as a main component a copolymer of:

(a) a styrenic monomer selected from the group consisting of alkyl styrene, dialkyl styrene, trialkyl styrene, alkenyl styrene, alkylalkenyl styrene, aryl styrene, and alkylaryl styrene; with (b) an acrylic monomer selected from the group consisting of acrylic acid, methacrylic acid, acrylic ester, methacrylic ester, and amino compounds thereof selected from the group consisting of dimethylaminoethyl methacrylate, dimethylaminoethyl acrylate, dimethylaminoethyl methacrylamide, 2-dimethylamino-1-methylethyl acrylate, 2-dimethylamino-1-methylethyl methacrylate, and dimethtlaminoethyl acrylamide.

4. A heat-sensitive recording paper as in claim 3, wherein the molar ratio of styrene monomer to acryl monomer is in the range of 99/1 to 5/95.

5. A heat-sensitive recording paper as in claim 3, wherein the molar ratio of styrene monomer to acryl monomer is in the range of 99/1 to 10/90.

6. A heat-sensitive recording paper as in claim 3, wherein the molar ratio of styrene monomer to acryl monomer is in the range of 99/1 to 30/70.

7. A heat-sensitive recording paper as in claim 1, wherein the cationic styrene-acryl copolymer is present in an amount of from 0.005 to 3.0 g/m$^2$.

8. A heat-sensitive recording paper as in claim 7, wherein the cationic styrene-acryl copolymer contained in the layer is present in an amount of from 0.01 to 2.0 g/m$^2$.

9. A heat-sensitive recording paper as in claim 1, wherein the base paper is neutralized.

10. A heat-sensitive recording paper as in claim 9, wherein the vinyl monomer containing a nitrogen atom is copolymerized with the cationic styrene-acryl copolymer.

11. A heat-sensitive recording paper as in claim 1, wherein said paper support further comprises a vinyl monomer containing a nitrogen atom.

* * * * *